US005304754A

United States Patent [19]

Marsh

[11] Patent Number: 5,304,754

[45] Date of Patent: Apr. 19, 1994

[54] CAM FOLLOWER

[75] Inventor: Beryl F. M. Marsh, Unionville, Conn.

[73] Assignee: Otis Elevator Company, Farmington, Conn.

[21] Appl. No.: 924,265

[22] Filed: Aug. 3, 1992

[51] Int. Cl.[5] ..... H01H 3/16

[52] U.S. Cl. ..... 200/47; 74/569; 74/10.006

[58] Field of Search ..... 200/47, 573, 574; 74/569, 567, 568 R, 568 FS, 568 M, 568 T, 10.29, 10.91, 10.35, 10.6, 107; 301/64.5; 152/323; 29/894, 894.31, 894.332, 894.351, 894.352, 894.361, 453; 72/67; 446/95, 96, 102, 465

[56] References Cited

U.S. PATENT DOCUMENTS 4,788,387 11/1988 Kasegi et al. ..... 200/47
5,117,885 6/1992 Crawford ..... 152/323

FOREIGN PATENT DOCUMENTS 49206 6/1992 European Pat. Off. ..... 446/465

*Primary Examiner*—Henry J. Recla
*Assistant Examiner*—David J. Walczak

[57] ABSTRACT

A cam follower disposed on a limit switch utilized in elevator systems comprises a tire and a hub. The tire comprises a torus and a web, wherein the web includes a plurality of elongated slots that allow free movement of the tire within the hub. The hub comprises two portions that snap fit together securing the tire therebetween so that when the tire of the cam follower is impacted, the tire absorbs the impact shock and minimizes noise caused by the impact. The cam follower design also allows an inexpensive fabrication and assembly.

11 Claims, 1 Drawing Sheet

CAM FOLLOWER

TECHNICAL FIELD

This invention relates to a cam follower for use in an elevator hoistway limit switch.

BACKGROUND ART

Conventional elevator systems utilize limit switches disposed on each floor inside an elevator hoistway. Each limit switch comprises a box-like enclosure and an arm. The arm further comprises a cam follower mounted on a spindle. As an elevator car reaches a certain floor, a cam disposed on a side of the elevator car comes into a contact with the cam follower to move the arm. The limit switch is activated by the arm movement to send a signal to a computer to let it know the exact location of the elevator cab at that particular time.

The cam followers are repeatedly impacted and must withstand much abuse. The cam followers are typically fabricated from either foam or hard rubber. The cam followers may also include a roller bearing or a similar device to absorb the impact of the elevator cam and to resume its original shape.

DISCLOSURE OF THE INVENTION

It is an object of the invention to provide a less expensive and more easily installable cam follower for a limit switch utilized in elevator systems.

It is a further object of the invention to provide a cam follower in an elevator limit switch that minimizes the noise produced on impact.

According to the invention, a cam follower for absorbing impact shock and for minimizing the transmission of noise upon impact comprises a tire and a hub, retaining the tire and moving independently thereof. The tire comprises a web having a disk-like shape and an outer diameter and a torus having a substantially round shape formed radially around the outer diameter of the web.

According to a feature of the invention, the web also includes a plurality of elongated slots.

According to a further feature of the invention, the hub comprises two portions that snap fit together, retaining the tire therebetween. The first hub portion includes a plurality of studs which are fitted through the plurality of elongated slots of the tire to snap fit into a plurality of apertures formed within the second portion of the hub.

As the tire is impacted, the tire moves radially inward, still retained by the hub, but free to move radially within the hub since the elongated slots do not restrict torus and web movement. Thus, the elongated slots allow the cam follower to absorb the impact shock and minimize the noise of the impact shock. The two parts of the hub that snap fit together facilitate inexpensive and easy installation and assembly.

These and other objects, features and advantages of the present invention will become more apparent in light of the following detailed description of a best mode embodiment thereof as illustrated in the accompanying drawing.

BEST MODE FOR CARRYING OUT THE INVENTION

Figure 1:
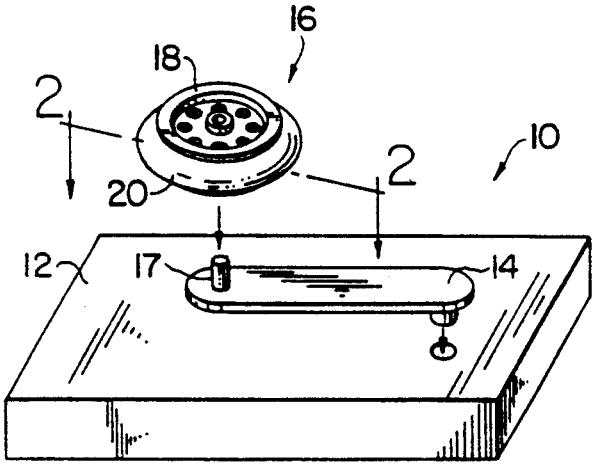
FIG. 1 is a top perspective view of a limit switch, an arm, and a cam follower of the present invention.
Figure 2:
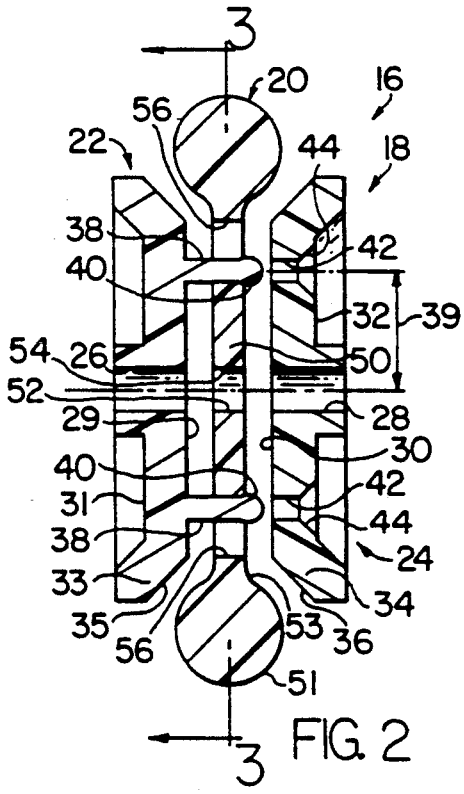
FIG. 2 is a cross sectional side view of a hub and a tire of the cam follower of FIG. 1 taken along the line 2—2.
Figure 3:
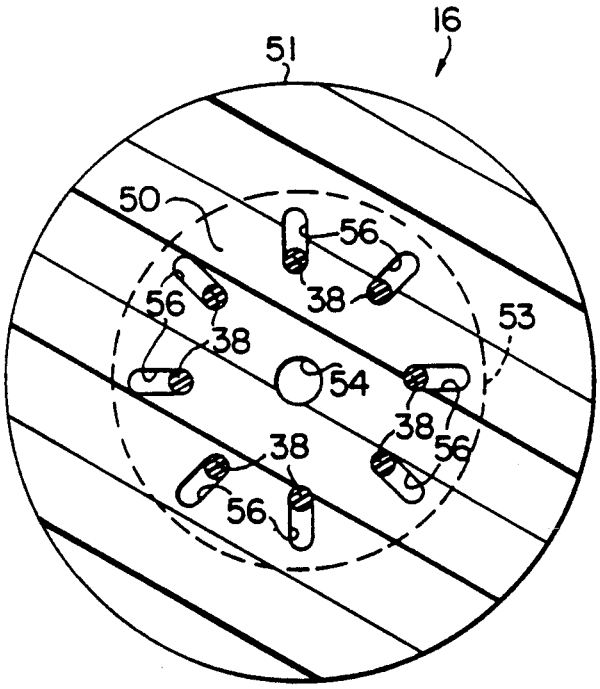
FIG. 3 is a front view of the tire and the hub of the cam follower of FIG. 2 taken along the line 3—3.

FIG. 1 depicts a limit switch 10 comprising a box 12, an arm 14, and a cam follower 16 fitted on a spindle 17. The cam follower includes a hub 18 and a tire 20. As shown in FIG. 2, the hub 18 further comprises two portions, a male 22 and a female 24. Both hub portions 22, 24 have a substantially circular shape (as can be seen in FIG. 3), with centrally disposed bores 26,28, respectively. Each hub portion has an inner surface 29,30 which faces the other hub portion and the outer surface 31,32 which faces outward, respectively. Both hub portions 22,24 have radially outwardly flared portions 33,34, the inner surfaces 35,36 thereof being chamfered.

The male hub portion 22, further includes a plurality of studs 38 protruding from the inner surface 29 disposed circumferentially outwardly from the central bore 26 at a radius 39. Each stud 38 further includes a rounded outer end 40.

The female portion 24 of the hub 18 includes a plurality of apertures 42 disposed circumferentially outwardly from the central bore 28 at the radius 39 in register with studs 38. On the outer surface 32 of the female portion 24, the apertures 42 contain an enlarged diameter 44.

The tire 20 is substantially circular and has a web portion 50 and a torus portion 51. The web portion has an inner diameter 52 and an outer diameter 53. The inner diameter 52 forms a central opening 54. A plurality of elongated slots 56 are disposed circumferentially outwardly from the central opening 54. The torus 51 is integrally formed around the outer diameter 53 of the web 50.

The studs 38 of the male hub portion 22 are inserted through the elongated slots 56 of the tire 20 and engage apertures 42 of the female hub portion 24. As the rounded outer end 40 of the studs 38 enters the enlarged diameter 44 of the apertures 42, the two hub portions 22,24 snap fit together, securing the tire 20 therebetween, thereby forming the cam follower 16.

The cam follower 16 is then fitted onto the spindle 17 of the arm 14 of the limit switch 10 as shown in FIG. 1, wherein the spindle 17 fits into the central bore 26,28 of the cam follower.

Figure 4:
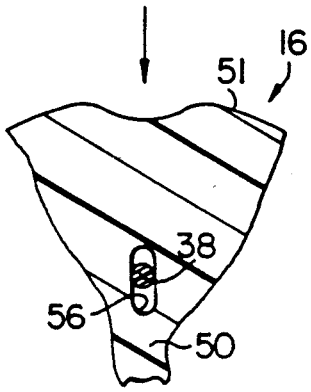
FIG. 4 is a front view, partially broken away, of the hub and the tire of the cam follower of FIG. 1 depicting the effect of the impact thereon.

The limit switch 10 is typically disposed on the inside of the elevator hoistway (not shown). An elevator car (not shown) includes a cam (not shown) disposed on the side thereof. As the elevator car moves vertically within the hoistway, the cam comes into contact with the cam follower 16 of the limit switch 10. More specifically, the torus 51 of the cam follower 16 comes into contact with the cam. As the tire 20 is impacted, the torus portion 51 and the attached web are deformed at the place of impact and the tire 20 moves radially inward as shown in FIG. 4. However, due to the elongated slots 56 formed within the web 50, the tire is free to move radially inward within the hub 18 without impacting the studs 38 thereof. Also, due to the elasticity of the material used for the tire fabrication, the impact shock is absorbed within the material itself and the tire 20 resumes its original shape. Furthermore, the noise of the impact is reduced due to the material of the tire and free movement of the tire within the hub 18. The chamfered surfaces 35,36 of the hub prevent the torus from hitting and abrading against a sharp edged hub.

The hub is constructed of a high strength, high lubricity, flame retardant plastic, such as DELRIN, manufactured by the E.I. Dupont De Nemoures and Company. The tire can be molded from plastic, such as SANTOPRENE 101-55 or other soft plastics.

Although the invention has been shown and described with respect to a best mode embodiment thereof, it should be understood by those of ordinary skill in the art that various omission, changes and additions in the form and detail thereof may be made without departing from the spirit and scope of the invention.

What is claimed is:

1. A cam follower disposed on a limit switch for use in an elevator system to indicate location of said elevator if a cam disposed on said elevator comes into contact with said cam follower wherein said limit switch includes a box-like enclosure and an arm protruding from said box-like enclosure being attached thereto on one end and having a protruding spindle on another end, said cam follower comprises:

a tire means for absorbing the impact shock and minimizing the impact noise, said tire means having a torus and a web, said web having a disk-like shape having a first outer diameter, said torus having a substantially round shape formed radially around said first outer diameter of said web, and a hub means for retaining said tire means and cooperating with said tire means such that said torus and said web move relative to said hub means in a radial direction, thereby absorbing the impact shock with minimal deformation and production of noise.

2. The cam follower of claim 1, wherein said means for moving relative to said hub means further comprises:

a plurality of radially extending elongated slots formed within said web and disposed circumferentially outwardly about a center axis thereof.

3. The cam follower of claim 2, wherein said hub means further comprises:

a first portion having a plurality of protruding studs extending outwardly, and a second portion having a plurality of apertures disposed in register with said studs, wherein said plurality of studs fits through said elongated slots of said tire means and snap fits into said plurality of apertures securing said tire means therebetween.

4. The cam follower of claim 1, wherein said tire means is fabricated from a soft plastic.

5. The cam follower of claim 1, wherein said hub means is molded from a high strength, high lubricity, flame retardant plastic.

6. A cam follower for absorbing impact shock and for minimizing noise of the impact comprises:

a tire means for absorbing the impact shock and minimizing the impact noise, said tire means having a torus and a web, said web having a disk-like shape having a first outer diameter, said torus having a substantially round shape formed radially around said first outer diameter of said web, and a hub means for retaining said tire means and cooperating with said tire means such that said torus and said web move relative to said hub means in a radial direction, thereby absorbing the impact shock with minimal deformation and production of noise.

7. The cam follower of claim 6, wherein said means for moving relative to said hub means further comprises:

a plurality of radially extending elongated slots formed within said web and disposed circumferentially outwardly about a center axis.

8. The cam follower of claim 7, wherein said hub means further comprises:

a first portion having a plurality of protruding studs extending outwardly, and a second portion having a plurality of apertures disposed in register with said studs, wherein said plurality of studs fits through said elongated slots of said tire means and snap fits into said plurality of apertures securing said tire means therebetween.

9. A cam follower for use in following a cam surface, said cam follower comprising:

a hub;

a tire means for engaging said cam surface, said tire means being constructed of a deformable, shock absorbing material and being supported by said hub, said tire means comprising;

a torus for impacting and following said cam surface, said torus having an outer surface for engaging said cam and an inner surface, said torus being spaced apart from said hub if not impacting said cam surface, and a web having;

a first outer diameter integrally formed with said inner surface of said torus, and means for cooperating with said hub such that upon impact of said torus with said cam surface said web and said torus deform relative to of said hub to minimize the transmission of noise causing vibrations thereto.

10. The cam follower of claim 9, wherein said means for cooperating with said hub further comprises:

a plurality of radially extending elongated slots formed within said web and disposed circumferentially outwardly about a center axis.

11. The cam follower of claim 10, wherein said hub further comprises:

a first portion having a second outer diameter and a plurality of protruding studs disposed circumferentially outwardly around a central axis at a radius, and a second portion having said second outer diameter and a plurality of apertures disposed circumferentially outwardly around said central axis at said radius to accommodate said plurality of studs of said first portion of said hub wherein said plurality of studs fits through said elongated slots of said tire means and fits into said plurality of apertures of said second portion of said hub securing said tire means therebetween.

* * * * *